United States Patent [19]

Collins

[11] Patent Number: 4,642,916

[45] Date of Patent: Feb. 17, 1987

[54] HEEL SPAWN

[76] Inventor: Van B. Collins, 7637 Canton, St. Louis, Mo. 63130

[21] Appl. No.: 873,675

[22] Filed: Jun. 12, 1986

Related U.S. Application Data

[63] Continuation of Ser. No. 678,465, Dec. 5, 1984, abandoned.

[51] Int. Cl.[4] ..... A43B 23/10; A43B 23/08

[52] U.S. Cl. ..... 36/58.6; 36/58.5; 36/68

[58] Field of Search ..... 36/55, 88, 92, 93, 68, 36/119, 7.1 A, 58.6, 71, 72 B, 58.5

[56] References Cited

U.S. PATENT DOCUMENTS

| | | | |
|---|---|---|---|
| 1,020,160 | 3/1912 | Rowe | 36/58.5 |
| 1,176,572 | 3/1916 | Lassig | 36/68 |
| 1,268,432 | 6/1918 | Cavanagh | 36/68 |
| 1,873,222 | 8/1932 | Shaw | 36/55 |
| 1,895,141 | 1/1933 | Watanabe | 36/55 |
| 1,946,591 | 2/1934 | Saito | 36/55 |
| 2,155,905 | 4/1939 | Protz | 36/58.5 |
| 2,562,514 | 7/1951 | Sibirkin et al. | 36/68 |
| 4,503,628 | 3/1985 | Mancinelli et al. | 36/58.6 |

*Primary Examiner*—Werner H. Schroeder
*Assistant Examiner*—Steven N. Meyers
*Attorney, Agent, or Firm*—Kalish & Gilster

[57] ABSTRACT

The present invention relates to podiatric appliances for a person's foot, and more particularly, to a device for the heel of a person's foot, which, when worn, provides cushioning for the heel to minimize friction and discomfort to the heel and reduces stocking wear.

8 Claims, 4 Drawing Figures

HEEL SPAWN

This is a continuation of application Ser. No. 678,465 filed Dec. 5, 1984, now abandoned.

FIELD OF THE INVENTION

The present invention relates to podiatric appliances for a person's foot, and more particularly, to a device for the heel of a person's foot, which, when worn, provides cushioning for the heel to minimize friction and discomfort to the heel, provides additional protection for a portion of the Achilles tendon, and reduces stocking wear.

BACKGROUND OF THE INVENTION

For as long as men and women have been wearing shoes, a certain portion of the population has suffered discomfort from the rubbing, and consequent chafing, that can occur at the heel due to poor fit, injury, or extended wear of the shoe. This rubbing and chafing has become a particular problem with the introduction of inexpensive, imported shoes which do not have a lining to cover the stitching done at the back of the heel of the shoe. Prior art, such as U.S. Pat. Nos. 38,134, 898,120, and 1,180,954, have taught covering the heel with a cap-like device to be worn over the heel and the stocking to prevent friction to the heel and wear to the stocking, which cap was then held in place by a band or strap. Similarly, other prior art, such as U.S. Pat. Nos. 1,669,790 and 2,438,280, have taught the lining of the bottom and a portion of the side of the shoe to reduce the friction, and consequent discomfort, and wear.

Unfortunately, none of the inventions have proved entirely satisfactory. It is to this dissatisfaction that the present invention is addressed.

SUMMARY OF THE INVENTION

The present invention provides a padded, firmly supported lining for the back of a shoe which presents a unitary member to the heel of a person's foot to prevent and reduce friction, and the resultant chafing, to the heel, to provide additional protection for a portion of the Achilles tendon, and to reduce wear to the person's stocking. The device of the present invention is cut from two pieces of leather, polyvinylchloride, polyurethane, vinyl or other similar flexible material which are sewed, glued or otherwise bonded together, and which encase an aluminum piece to which additional padding has been affixed, and in which a tab has been provided at the top of the device which is to be folded over the top of the back of the shoe to help maintain the position of the device when in use. Only a few sizes would need to be manufactured to provide for a whole range of men's and women's shoe sizes.

In use the device is slipped into the back of the shoe so that the bottom of the device adjoins the the socklining and the top tab is folded over the top of the shoe back.

The many advantages of the invention include the following. The device of the present invention, being seamless, protects the heel of the person's foot so that it does not come into contact with the seam or other uneven portion of the shoe, and consequently eliminates the rubbing and chafing which may occur. The aluminum form being somewhat pliable, can be easily shaped to fit the back of the foot. The device offers protection for a portion of the Achilles tendon from possible injury, as well as to the heel of the person's foot from uneven portions of the shoe. Additional protection is offered by the padding affixed to the aluminum, which padding also promotes comfort when walking. The sewed, glued or otherwise bonded edges along the side of the device blend into the side of the shoe and offer additional comfort to the wearer. Unlike some of the previously mentioned prior art, the device of the present invention does not have a band or strap across the top of the person's foot, which may cause swelling or other irritation to the foot of the person wearing the device. Similarly, since the device of the present invention extends from the top of the back of the shoe to the socklining and overlay above the sole of the shoe, no irritation will occur due to the device rubbing a person's foot at some intermediate point. Another advantage of the device of the present invention is that the pliancy of the aluminum form covered by the soft leather or vinyl or similar type of material allows the device to support the back of the shoe to prevent it from wrinkling or slipping, while protecting the heel of the person's foot from resultant poor fits. Another advantage of the present invention is the stability offered by the tab which folds over the top of the back of the shoe and prevents slipping of the device in the back of the shoe. Still another advantage of the device is that it is easily inserted and therefore convenient to use. Additionally the device of the present invention reduces wear to the stocking of a person, since it presents a smoothly finished piece of leather or vinyl or similar type of material to the foot and stocking and thereby eliminates any snagging due to the roughness of the back of a shoe and because it extends along the entire back of the shoe.

The invention accordingly comprises the products hereinafter described, the scope of the invention being indicated in the following claims.

DETAILED DESCRIPTION OF THE INVENTION

Figure 1:
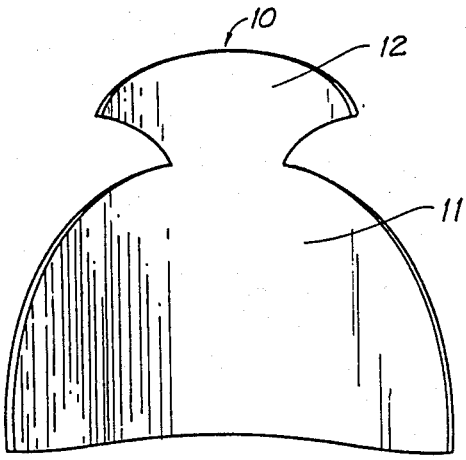
FIG. 1 is a view of the present invention as seen from the front and as it would fit against the heel of a person's foot.

Referring now to the drawings wherein like reference characters represent like elements, FIG. 1 shows the exterior of device generally designated as 10 of the present invention. Front cover 11 is cut from leather, polyvinylchloride, polyurethane, vinyl, or other similar flexible material with tab 12, which is to be folded over the top of the shoe when the device is inserted into the back of a shoe.

Figure 2:
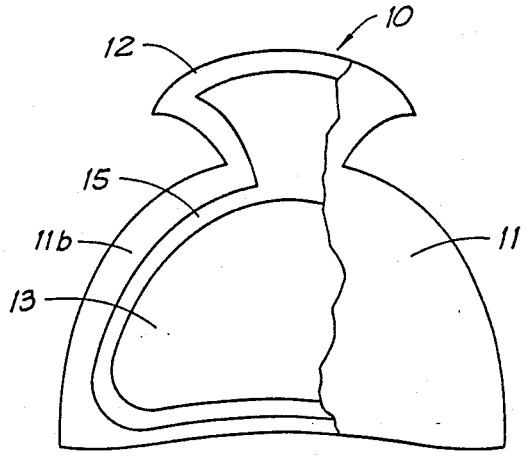
FIG. 2 is a partial cut away view showing the internal construction as viewed from the front.

FIG. 2 shows a partial cut away view of the internal construction of device 10, as seen from the front of the device, wherein a portion of cover 11 which would fit against the user's foot is cut away to show padding 13 affixed on aluminum form 15, which lays against rear cover **11*b* which abuts the back of the shoe, and showing tab 12**, which is to be folded over the top of the back of a shoe when the device is in use.

Figure 3:
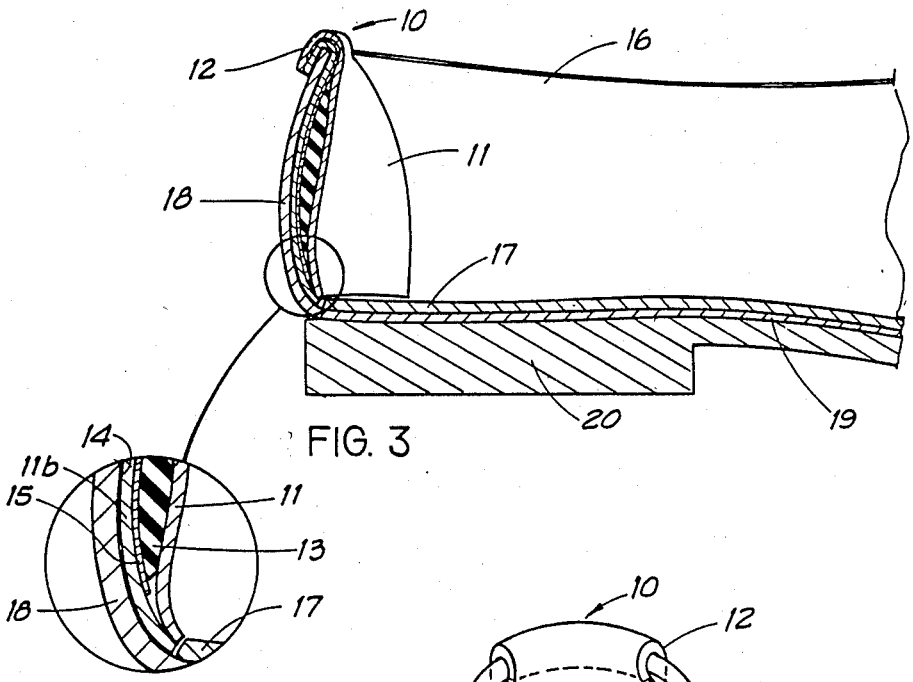
FIG. 3 is a cut away of a partial side view showing how the present invention fits in a shoe with the tab folded over the top of a shoe.

FIG. 3 shows device 10 in shoe 16 from a cut away side view with tab 12 folded over back 18 of shoe 16 and lying against the outside of the shoe. The rear of back cover 11*b* will be seen next to back 18 of shoe 16, with aluminum form 15 laying between back cover 11*b* and padding 13, which is then covered by the front cover 11. The bottom of device 10 will be seen to be at the juncture between back 18 of shoe 16 and socklining 17, which covers overlay 19 and heel 20.

Figure 4:
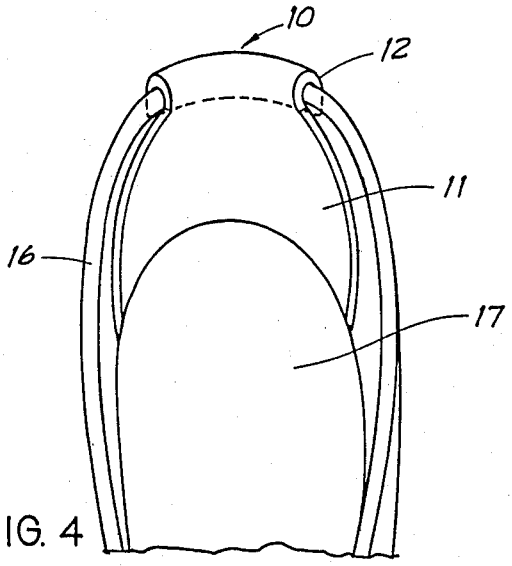
FIG. 4 is a partial perspective as seen from above and slightly in front of the back portion of a shoe showing how the present invention looks when in a shoe.

FIG. 4 shows device 10 from an elevated perspective looking into the back of shoe 16 with tab 12 folded over as the device would be seen in use.

From the foregoing description, it will be readily understood that the device is slipped into the back of the shoe so that the bottom of the device lies at the juncture of the back of the shoe and the socklining and the tab is folded over the top of the back of a shoe, thereby creating a stable liner for the back of a shoe which will not slip or wrinkle, which will eliminate the rubbing and subsequent chafing which can occur as a result of poor fit, injury, extended wear of the shoe, or inexpensive construction, which will provide protection to a portion of the Achilles tendon from possible injury, and which will reduce stocking wear.

In an alternative construction, adhesive 14 may be applied to the side of device 10 abutting the inside of back 18 of shoe 16 so as to improve the ability of the device to remain in the desired position. This adhesive may be any of the various known adhesives, either pre-applied or separately applied immediately prior to installation in the shoe. The adhesive may also be either of a type which will permanently bond the device into the shoe or of a type which is non-permanent in nature and will permit the devices electively to be removed for installation in a different shoe. Typically, aluminum insert 15 is fabricated from 24 gauge aluminum in an annealed or semi-soft heat treated condition whereby it is somewhat pliable, as earlier noted, for easily shaping the new podiatric appliance to fit the back of the foot, i.e., heel.

Although the present invention has described and illustrated with respect to a preferred embodiment thereof, it is to be understood that it is not to be so limited since changes and modifications may be made therein which are within the full intended scope of this invention as hereinafter claimed.

What is claimed is:

1. For use with a shoe, a podiatric appliance of unitary character for selective insertion interiorly of a shoe along the back of the shoe and for selective removal therefrom to provide heel lining for the back of the shoe, comprising:

front and back covers each of flexible material, the front cover and back cover each having identically configured upper and lower portions, the lower portion of the front cover providing a surface confronting the heel of a wearer of the shoe and the lower portion of the back cover confronting the back of the shoe, the lower portions both extending from a socklining of the shoe to the top of the back of the shoe coextensively with the back of the shoe;

a thin gauge aluminum form having lower and upper portions positioned between the front and back covers of pliable character for shaping the appliance to fit the heel of the wearer;

a layer of padding positioned between the aluminum form and the front cover;

the lower portion of the aluminum form and layer of padding each being of area less than the lower portions of the front and back covers to provide the front and rear covers with marginal portions surrounding at least portions of the aluminum form and layer;

first means for securing together the front and back cover marginal portions to provide side edges smoothly meeting interior surfaces of sides of the shoe;

the lower portions of the front and back covers having a lower edge meeting the socklining and side edges and extending in converging relation from the lower edge to provide a neck of narrow width between upper and lower portions of the front and back covers, the neck being located substantially at the top of the back of the shoe;

the upper portions of the front and back covers having side edges extending in diverging relation from the neck to an upper edge of curvilinear shape to provide a tab for being folded over the top of the back of the shoe for stabilizing the appliance within the shoe; and non-permanent adhesive provided on a shoe-confronting surface of the lower portion of the back cover for causing the appliance to be adhered within the shoe but selectively removed for being installed in a different shoe.

2. For use with a shoe, a podiatric appliance as set forth in claim 1 wherein the aluminum form comprises a lower portion shaped complementarily to the lower portions of the front and rear cover, and an upper portion shaped complementarily to the upper portions of front and back covers and extending upwardly of said neck for thereby constituting an element of the tab.

3. For use with a shoe, a podiatric appliance as set forth in claim 2 wherein the upper portion of the aluminum form defines side edges and an upper edge, spaced inwardly of corresponding side and upper edges of upper portions of the front and back covers, to provide the cover upper portions with marginal portions, and further means for securing together the cover upper marginal portions.

4. For use with a shoe, a podiatric appliance as set forth in claim 3 wherein the layer of padding overlies only the lower portion of the aluminum form.

5. For use with a shoe wherein the socklining extends substantially to the rear of the shoe, a podiatric appliance as set forth in claim 4 wherein the lower edges of the front and back covers meet but do not overlie the socklining.

6. For use with a shoe, a podiatric appliance according to claim 5 wherein the first and further securing means is constituted by bonding.

7. For use with a shoe, a podiatric appliance according to claim 5 wherein the first and further securing means is constituted by adhesive.

8. For use with a shoe, a podiatric appliance according to claim 5 wherein the first and further securing means is constituted by stitching.

* * * * *